US005630405A

United States Patent [19]

Nizov

[11] Patent Number: 5,630,405

[45] Date of Patent: May 20, 1997

[54] SHOOTING BOW WITH SPRINGBACK COMPENSATION

[76] Inventor: Sergei N. Nizov, ulitsa Latyshskikh Strelkov, 1, kv. 13, Orel, Russian Federation

[21] Appl. No.: 428,104

[22] PCT Filed: Apr. 4, 1994

[86] PCT No.: PCT/RU94/00071

§ 371 Date: Apr. 28, 1995

§ 102(e) Date: Apr. 28, 1995

[87] PCT Pub. No.: WO95/08091

PCT Pub. Date: Mar. 23, 1995

[30] Foreign Application Priority Data

Sep. 15, 1993 [RU] Russian Federation ..... 93044916
Nov. 15, 1993 [RU] Russian Federation ..... 93051887

[51] Int. Cl.[6] ..... F41B 5/12

[52] U.S. Cl. ..... 124/25; 124/25.6

[58] Field of Search ..... 124/25, 25.6

[56] References Cited

U.S. PATENT DOCUMENTS 3,443,558 5/1969 Peck .
4,649,891 3/1987 Bozek ..... 124/25
4,697,571 10/1987 Waiser ..... 124/25
4,732,134 3/1988 Waiser ..... 124/25
4,879,987 11/1989 Nishioka ..... 124/25
4,926,834 5/1990 Chauvin ..... 124/25
4,976,250 12/1990 Jeffrey ..... 124/25
5,119,797 6/1992 Anderson ..... 124/25

FOREIGN PATENT DOCUMENTS 3405463 8/1985 Germany .

*Primary Examiner*—John A. Ricci
*Attorney, Agent, or Firm*—Keck, Mahin & Cate

[57] ABSTRACT

A shooting bow is employed for shooting in sporting events and for shooting game. The shooting bow includes a main part, arms, convex in the direction of shooting, and pulleys, fastened to free tips of the arms. A bowstring passes via the pulleys, and a frame mounts the main part and a trigger mechanism. On the frame there are fastened a guide of a carriage, made up with a track, a groove for the bowstring and cutouts. The number of cutouts corresponds to the number of fletchings of an arrow. The arms are made so that the total impulse of the "arms-pulleys" and "arrow-carriage" systems, at each instant of arms straightening, approaches zero.

3 Claims, 3 Drawing Sheets

SHOOTING BOW WITH SPRINGBACK COMPENSATION

BACKGROUND OF THE INVENTION

1. Field of the Invention

The present invention relates to a shooting bow that can be used for target or game shooting.

2. Description of the Related Art

Known are technical solutions, similar to the present one, for instance, a bow for shooting, used in hunting and in sporting events, comprising a frame, arms, disposed at a small angle relative one to another, having eccentric rollers at their tips, utilized to redistribute the bow forces (see U.S. Pat. No. 4,976,250, date of publication—Dec. 11, 1990).

The bow features a soft springback due to a parallel disposition of the arms; however, its shape does not provide for springback compensation during shooting and the bow is displaced backwards and upwards, which has a poor effect on the accuracy of hits. Besides, since the bowstring thrusts against the arrow tail piece, the arrow shaft is subjected to compression and, as a result, in the process, the amplitude of the arrow self-oscillations increases, which, in turn, reduces the range and accuracy of a hit.

There is also a prior art shooting bow for target shooting, comprising arms, attached to the central element and convex in the direction of shooting, pulleys, a bowstring, manufactured in the form of two end spans and one middle span, a frame and a trigger mechanism (see U.S. Pat. No. 4,879,987, publication date—Nov. 14, 1989).

This prior art shooting bow, according to the technical solution, is made compact, but features the drawbacks of the foregoing bow.

SUMMARY OF THE INVENTION

The purpose to be achieved in the course of designing a new structure of a shooting bow has consisted of ensuring improved accuracy, increasing the range of shooting with a similtaneous decrease of weight of said shooting bow as well as creating more comfort for the bowman.

The purpose of the invention is to increase the accuracy of shooting with a simultaneous decrease of the bowman's contribution to the result of a shot, to decrease the weight of said shooting bow as well as to increase the effective range of shooting.

The purpose is achieved thanks to including a carriage into the prior art shooting bow, disposed on the bowstring. The carriage is manufactured with cutouts, located on the front surface thereof, the number of which corresponds to the number of arrow fletchings, and with a longitudinal track on the bottom and a groove for the bowstring. At the same time, the lower edges of the exit holes of the groove are positioned below the upper surface of the longitudinal track of the carriage, the arrow head contains fletchings with cutouts in the rear part, able to enter respective cutouts of the carriage, the tail piece of the arrow is made tapering, and the frame is made up with a carriage guide, with a horizontal slit in the forward part and a slot, in which the arrow guide is mounted, with the end spans of the bowstring passing via the horizontal slit in the frame. The carriage is manufactured movable along the carriage guide, the distance between which and the upper surface of the longitudinal track of the carriage being greater than the diameter of the arrow. The point of locking the arrow in the carriage is located in front of the centre of gravity of the arrow, whereas the width of the arrow head is smaller or equal to the width of said slot in the frame of the shooting bow and greater than the diameter of the arrow shaft. The profile of said puleys is preferably designed to meet the condition: $\Delta S_1 = K x \Delta S_2$ where:

$\Delta S_1$ is a displacement of the centre of mass $M_1$ to position $M_1$ ' of the system "arms-pulleys";

$\Delta S_2$ is a displacement of the centre of gravity $M_2$ to position $M_2$ ' of the system "arrow-carriage";

K is a constant for each specific shooting bow and for each instant in the course of straightening of the arms, which makes a relation: $\Delta S_1/\Delta S_2$, while the arms satisfy the condition, when the total impulse of the systems "arms-pulleys" and "arrow-carriage", that acts on the main part at the point the arms are attached thereof, at each instant of straightening of the arms, approaches zero.

Additionally, the end spans of the bowstring are made bifurcated, the middle span is made up with swellings, and the arrow is furnished with stabilizers, disposed on the fletchings of the arrow head at an angle of 0°to 20° to the arrow axis, with a space between the inner edges of two adjacent stabilizers in the direction perpendicular to the plane of arms being greater than the diameter of the bowstring. At the tips of the arms a pulling cord is attached an elastic rope, secured to the frame. Due to the introduction of the structural elements into the shooting bow, according to the invention, the accuracy of shooting increases, the range of shooting rises and the weight of the shooting bow goes down.

DESCRIPTION OF THE DRAWINGS

The present invention is illustrated by diagrams, which depict the various features of the invention.

DESCRIPTION OF THE PREFERRED EMBODIMENTS

Figure 1A:
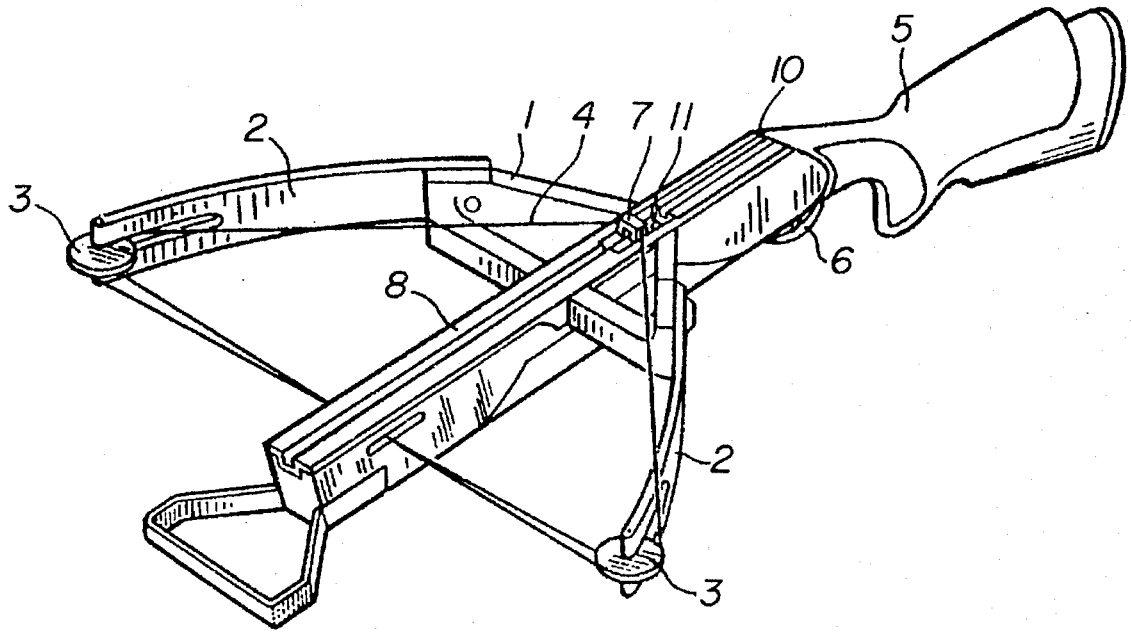
FIG. 1*a* is a general view of the shooting bow according to the invention.
Figure 1B:
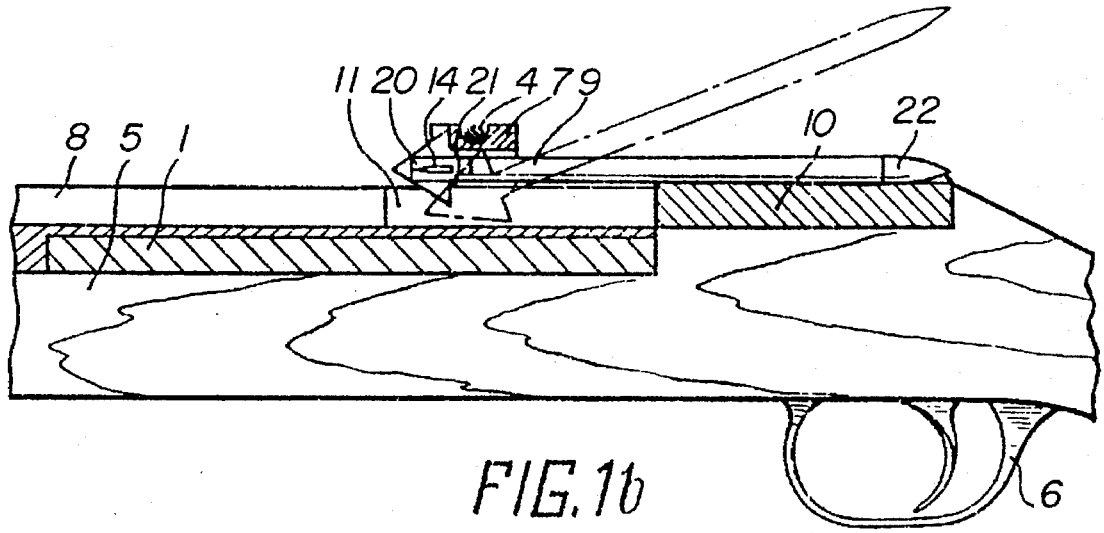
FIG. 1*b* is a longitudinal section of the shooting bow.
Figure 1C:
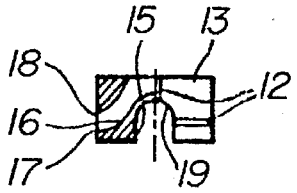
FIG. 1*c* is a shooting bow carriage.

The invention, according to FIGS. 1*a*, 1*b* and 1*c*, comprises a main part (1), arms (2), pulleys (3), a bowstring (4) consisting of two end spans and one middle span, a frame (5), a trigger mechanism (6), a carriage (7), a carriage guide (8), an arrow guide (10), with the arms (2), mounted on the main part (1), convex in the direction of shooting and with pulleys (3), disposed at their tips. The bowstring (4) is passed via the pulleys (3). The main part (1) is mounted on the frame (5), manufactured with the trigger mechanism (6), with the carriage guide (8), with a horizontal slot (not designated), located in its forward part, through which the end spans of the bowstring (4) are passed and with a slot (11), in which the arrow guide (10) is disposed. The bowstring (4) mounts the carriage (7), made up with cutouts (12), located on its front surface (13), the number of which corresponds to the number of fletchings (14) of the arrow (9), entering the carriage (7), with a longitudinal track (15), disposed on its bottom part and a groove (16) for the bowstring (4), the lower edges (17) of exit holes (18) of which are disposed below the upper surface (19) of the longitudinal track (15) with the carriage made movable along the carriage guide, a distance between which and the upper surface of the carriage longitudinal track being greater than the diameter of the arrow that is furnished with a head (20), having the fletchings (14), each of which is manufactured with a cutout (21) and with a tapered tail piece (22). The point of the arrow fixation in the carriage is in front of the centre of gravity of the arrow, while the width of the arrow head is smaller or equal to the width of the slot in the frame of the shooting bow and greater than the diameter of the arrow shaft, with the profile of the pulleys striving to satisfy the condition $\Delta S=K x \Delta S_2$, where:

$\Delta S_1$ is a displacement of the centre of gravity of mass $M_1$ to position $M_1$ ' of the system "arms-pulleys";

$\Delta S_2$ is a displacement of the centre of gravity of mass $M_2$ to position $M_2$ ' of the system "arrow-carriage";

K is a constant for a specific shooting bow and for each instant of strightening the arms, which is determined from the relation: $\Delta S_1/\Delta S_2$.

The arms satisfy the condition when the total impulse of the systems "arms-pulleys" and "arrow-carriage" that act on the main part, at the point of the arms fixation to it at each instant of arms straightening, approaches zero.

The invention according to FIG. 1*a* operates as follows: when arming, it is required to draw the bowstring (4) towards the bowman until it is caught by its trigger mechanism (6). Then, the arrow (9) is taken by its shaft to introduce it into the slot (8) of the frame (5). As soon as the arrow head occupies a position ahead of the carriage (7), the arrow is displaced upwards and backwards and, in the process, the cutouts (21) will enter the cutouts (12) of the front surface (13) of the carriage (7), while the shaft enters the arrow guide (10). The described arming procedure is the safest, since the hand of the bowman does not touch the head of the arrow. When shooting, the bowman releases the bowstring (4). In the process the arms sharply straighten up, imparting a required velocity to the arrow, and since the arms (2) are bent in the direction of shooting, the total impulse of the systems "arms-pulleys" and "arrow-carriage", acting upon the main part at the point of the arms attachment to it, at each instant of arms straightening, approaches zero.

Figure 1D:
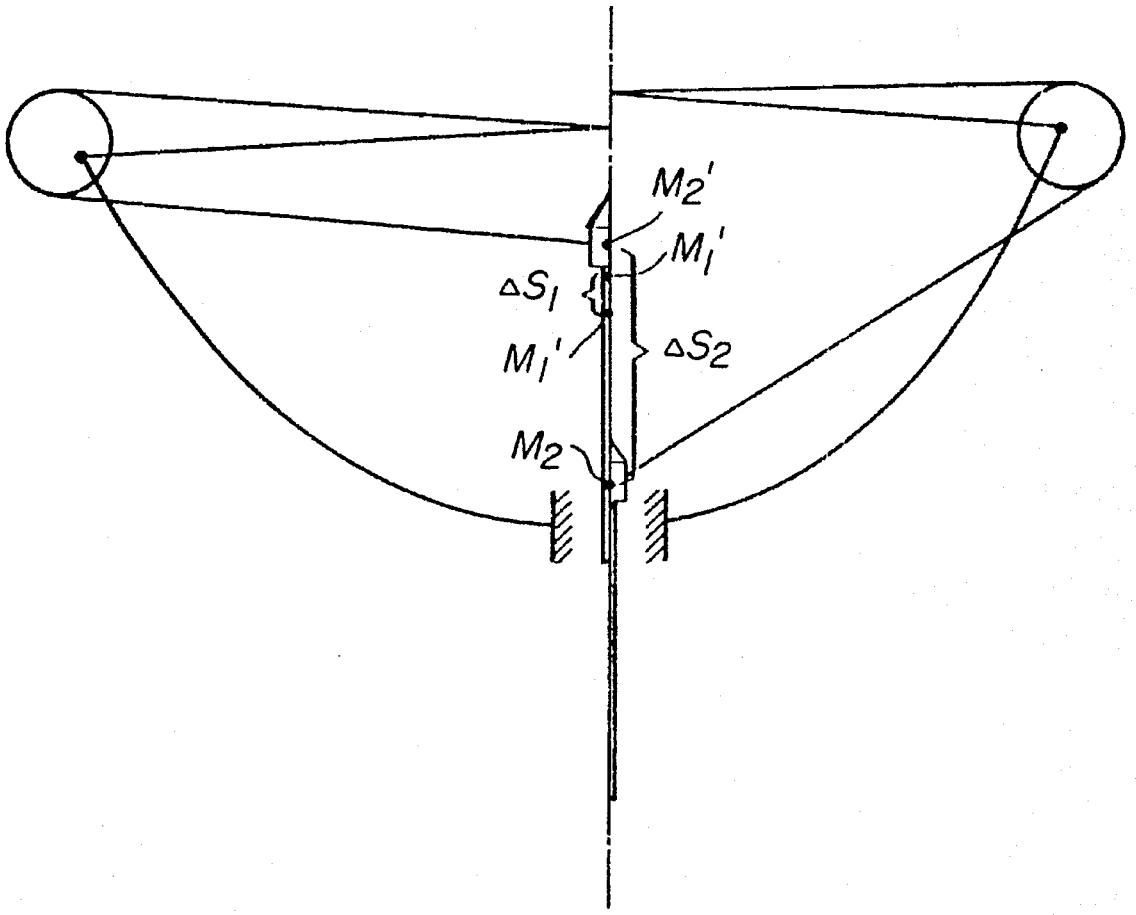
FIG. 1*d* is a springback compensation diagram of the shooting bow.

In this way the springback is compensated for. To provide for a full equality of impulses at each instance, use is made of pulleys (3) with a profile striving to satisfy the condition: $\Delta S_1=K x \Delta S_2$, presented in FIG. 1*d*, where:

$S_1$ is a displacement of the centre of mass $M_1$ to position $M_1$ ' of the system "arms-pulleys";

$\Delta S_2$ is a displacement of the centre of mass $M_2$ to position $M_2$ ' of the system "arrow-carriage";

K is a constant for each specific shooting bow and at each instant in the course of the arms straightening, which is determined from the relation $K=\Delta S_1/\Delta S_2$.

Because the arrow shaft (9) is shorter than the distance from the front edge of the arrow guide (10) to the carriage (7) in the forward position, said arrow is disconnected from the shooting bow immediately after the straightening of the arms and the developed displacement of the shooting bow does not deflect said arrow from the desired direction. In this case there is practically no angle of propelling and therefore the accuracy of shooting does not depend on the constitution of the bowman and his skills in uniform shooting bow levelling. The range of shooting is increased thanks to the possibility of utilizing more powerful arms (2) with no increase in the springback and no drop in the accuracy of shooting and because the arrow, the shaft of which is subjected to tension, can be made thinner than usual (4 to 5 mm), which improves the ballistic coefficient and preserves the velocity of the arrow in flight. Due to the fact that the centre of gravity of said arrow is displaced forwardly through a maximum distance, the effect of atmospheric disturbances (wind) on the arrow is reduced, which increases the accuracy of shooting.

Figure 2A:
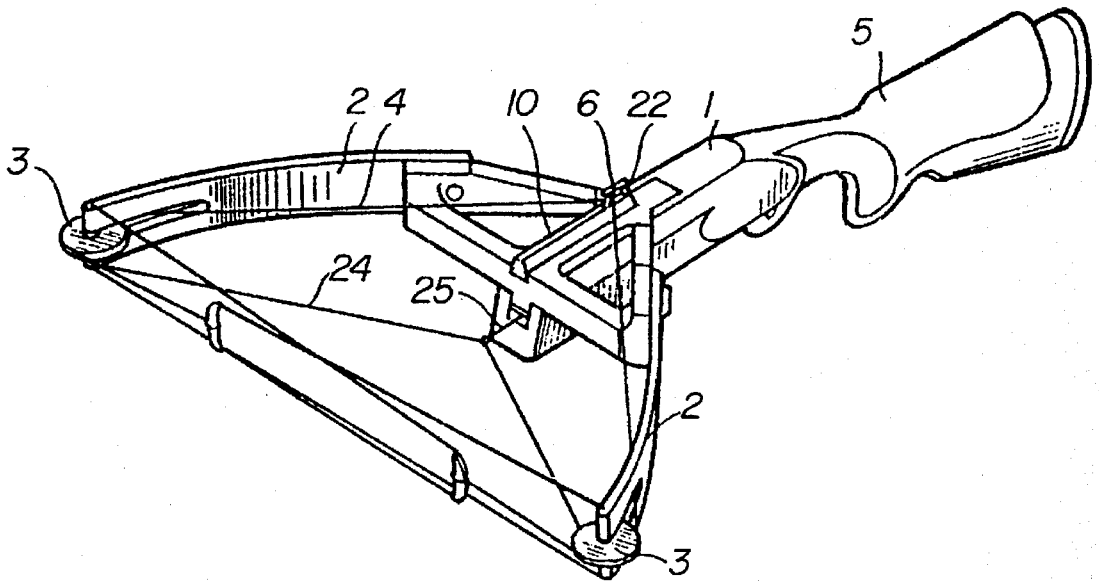
FIG. 2*a* is a general view of an embodiment of the shooting bow.
Figure 2B:
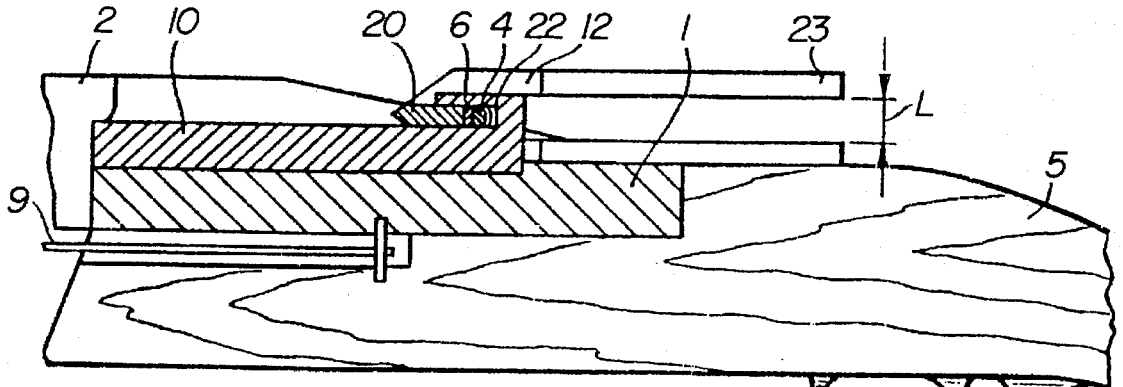
FIG. 2*b* is a longitudinal section of the embodiment of the shooting bow according to FIG. 2*a*.

A device depicted in FIGS. 2*a* and 2*b* is an embodiment of the invention, shown in FIG. 1*a*, and comprises a main part (1) that mounts arms (2), convex in the direction of shooting, having pulleys (3) at their tips, through which a bowstring is passed, consisting of two end spans and one middle span, designated by the refernece number (4) in the drawings.

Figure 2C:
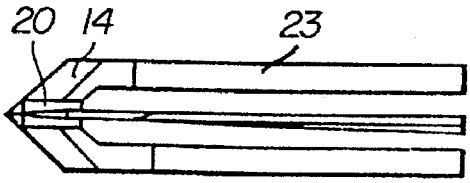
FIG. 2*c* is a shooting bow arrow.

The main part (1) is mounted on a frame (5) with a trigger mechanism (6). In this case, the end spans of the bowstring (4) are manufactured bifurcated, the middle span of the bowstring is provided with swellings (22) and the arm (2) tips carry a pulling cord (24), mounted along with an elastic rope (25), secured to the frame (5). Said frame (5) is made up with an arrow guide (10), whereas the arrow, depicted in FIG. 2*c*, is manufactured together with stabilizers (23), mounted on the fletchings (14) of the arrow head (20), the distance between the inner edges of two adjacent stabilizers, in the direction perpendicular to the plane of arms being greater than the diameter of the bowstring.

The operation of the device according to FIG. 2*a* is carried out as follows. When aiming the shooting bow, the pulling cord (24) is stepped on by a foot and the bowstring (4) is drawn backwards. In the process, thanks to bending of the pulling cord (24), the total stroke for arming is increased, and an effort to draw the bowstring (4) is reduced. With the bowstring (4) caught, the trigger mechanism (6) lets off the pulling cord (24), which is taken backwards with the aid of the elastic rope (25). Afterwards, by taking the arrow by its stabilizer (23), the arrow is positioned in the arrow guide (10), until it is in contact with the bowstring (10) between swellings on the bowstring (22). When shooting, the shooting bow arms straighten up and the arrow is in contact only with the bowstring (4); in the process, the effect of the frame displacement is removed because of a distance, between two adjacent stabilizers (23) in the direction perpendicular to the plane of the arms, being greater than the diameter of the bowstring and the end spans of the bowstring being made bifurcated.

The description set forth above of the shooting bow embodiment is optimal, as its frame is short, the weight is small and the drawing force, applied to the bowstring, is reduced. The shooting bow provides, also for a high accuracy and a considerably effective range of shooting as well as no dependence of the result of shooting on the levelling procedure.

I claim:

1. A shooting bow comprising:

a main part;

a frame on which the main part is mounted;

arms, mounted on the main part and convex in a direction of shooting;

pulleys disposed at tips of the arms;

a bowstring, made up from two end spans and one middle span, passing said pulleys and through a horizontal slotted hole in the frame; and a trigger mechanism mounted on the frame;

characterized in that said shooting bow further comprises a carriage, arranged on said bowstring, and a carriage guide, said frame is manufactured with a frame slot and a horizontal slotted hole disposed in its forward part, said carriage is made up with a groove for said bowstring, the carriage guide is arranged in the frame slot, the carriage is movable along said carriage guide, and the profile of the pulleys satisfies a relationship $\Delta S_1 = K x \Delta S_2$, wherein:

$\Delta S_1$ is a displacement of a centre of mass $M_1$ to a position $M_1'$ of a system including said arms and said pulleys;

$\Delta S_2$ is a displacement of a centre of mass $M_2$ to a position $M_2'$ of a system including an arrow and said carriage; and K is a constant for a specific shooting bow at each instant of straightening of the arms, which is determined from $\Delta S_1/\Delta S_2$, the arms satisfying the condition, when a total impulse of said systems acting on the main part at a point of fixation of said systems, at each instant of straightening of the arms, approaches zero.

2. A shooting bow according to claim 1, characterized in that said groove for said bowstring is made up with exit holes, lower edges of which are disposed below an upper surface of a longitudinal track of the carriage.

3. A shooting bow according to claim 1, and further comprising a pulling cord, wherein end spans of said bowstring are bifurcated, a middle span of said bowstring is made with swellings, and said pulling cord is made with an elastic rope, secured to the frame and fixed to the tips of the arms.

* * * * *